US012404861B2

(12) United States Patent
Shi et al.

(10) Patent No.: US 12,404,861 B2
(45) Date of Patent: Sep. 2, 2025

(54) VACUUM PUMP AND ROTATING BODY FOR VACUUM PUMP

(71) Applicant: Edwards Japan Limited, Chiba (JP)

(72) Inventors: Yongwei Shi, Chiba (JP); Haruki Suzuki, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 18/263,257

(22) PCT Filed: Feb. 9, 2022

(86) PCT No.: PCT/JP2022/005206
§ 371 (c)(1),
(2) Date: Jul. 27, 2023

(87) PCT Pub. No.: WO2022/176745
PCT Pub. Date: Aug. 25, 2022

(65) Prior Publication Data

US 2024/0093688 A1 Mar. 21, 2024

(30) Foreign Application Priority Data

Feb. 19, 2021 (JP) ..... 2021-025072

(51) Int. Cl.
*F04D 19/04* (2006.01)

(52) U.S. Cl.
CPC ..... *F04D 19/042* (2013.01)

(58) Field of Classification Search
CPC ..... F04D 19/04; F04D 19/042; F04D 29/266
See application file for complete search history.

(56) References Cited

U.S. PATENT DOCUMENTS 5,219,269 A * 6/1993 Ikegami ..... F04D 19/04 415/55.1
6,926,493 B1 * 8/2005 Miyamoto ..... F04D 19/042 415/177

(Continued)

FOREIGN PATENT DOCUMENTS

JP H074383 A 1/1995
JP H10246197 A 9/1998

(Continued)

OTHER PUBLICATIONS

PCT International Search Report dated Apr. 5, 2022 for corresponding PCT application Serial No. PCT/JP2022/005206, 3 pages.

(Continued)

*Primary Examiner* — Nathaniel E Wiehe
*Assistant Examiner* — Jackson N Gillenwaters
(74) *Attorney, Agent, or Firm* — Theodore M. Magee; Westman, Champlin & Koehler, P.A.

(57) ABSTRACT

A vacuum pump which can reduce a stress generated in a connected part between a rotating body and a rotating shaft is provided. A rotating body is provided having rotor blades provided on an outer periphery of a rotor-blade forming portion, and fastened to the rotor shaft by a bolt, and rotatable with the rotor shaft. At least either one of a fitting hole portion fitted with the rotating shaft and a through hole portion, through which a bolt penetrates, in the rotating body is a stress-reduction target portion, and a groove portion that reduces stress generated in the stress-reduction target portion during rotation of the rotating body is provided.

9 Claims, 11 Drawing Sheets

(56) References Cited

U.S. PATENT DOCUMENTS

| | | | | |
|---|---|---|---|---|
| 10,781,820 | B2 * | 9/2020 | Watanabe | F16L 15/008 |
| 2005/0249618 | A1 * | 11/2005 | Nonaka | F04D 19/04 417/423.4 |
| 2007/0031270 | A1 * | 2/2007 | Maejima | F04D 19/042 417/423.4 |
| 2018/0283386 | A1 * | 10/2018 | Kuno | F04D 19/044 |

FOREIGN PATENT DOCUMENTS

| | | | | |
|---|---|---|---|---|
| JP | 2005320905 | A | 11/2005 | |
| JP | 2006194083 | A | 7/2006 | |
| JP | 2008286013 | A | 11/2008 | |
| JP | 2019138258 | A | 8/2019 | |
| WO | WO-2008035497 | A1 * | 3/2008 | F04D 19/042 |
| WO | 2021015018 | A1 | 1/2021 | |

OTHER PUBLICATIONS

PCT International Written Opinion dated Apr. 5, 2022 for corresponding PCT application Serial No. PCT/JP2022/005206, 4 pages.
European communication dated Dec. 13, 2024 and Supplementary Search Report dated Dec. 5, 2024 for corresponding European application Serial No. EP22756066, 7 pages.

* cited by examiner (b) STRUCTURE MODEL ACCORDING TO EMBODIMENT (a) CONVENTIONAL STRUCTURE MODEL

VACUUM PUMP AND ROTATING BODY FOR VACUUM PUMP

CROSS-REFERENCE OF RELATED APPLICATION

This application is a Section 371 National Stage Application of International Application No. PCT/JP2022/005206, filed Feb. 9, 2022, which is incorporated by reference in its entirety and published as WO 2022/176745A1 on Aug. 25, 2022 and which claims priority of Japanese Application No. 2021-025072, filed Feb. 19, 2021.

FIELD

The present invention relates to a vacuum pump such as a turbo molecular pump and a rotating body for the vacuum pump, for example.

BACKGROUND

In general, a turbo molecular pump is known as one type of a vacuum pump. This turbo molecular pump is configured such that a rotor blade is rotated by conduction to a motor inside a pump main-body so as to flick off gas molecules of a gas (process gas) sucked into the pump main-body, whereby the gas is exhausted. Moreover, in this type of the turbo molecular pump, a rotating shaft (rotor shaft) is connected to the rotating body, on which the rotor blade is formed, so that the rotating shaft and the rotating body are rotated by the motor and perform exhaustion.

The discussion above is merely provided for general background information and is not intended to be used as an aid in determining the scope of the claimed subject matter. The claimed subject matter is not limited to implementations that solve any or all disadvantages noted in the background.

SUMMARY

By the way, in the vacuum pump such as various turbo molecular pumps as described above, in general the more a rotation number of the rotor blade is increased, the higher the exhaust performance becomes. However, as a result of structural analysis by the inventor and the like by paying attention to a connected part between the rotating body and the rotating shaft, it has been found out that stress concentration can easily occur at the connected part.

In order to reduce such stress generated at the connected part between the rotating body and the rotating shaft, setting of a rotation number at low during a rated operation can be considered, but if the rotation number is lowered, improvement of the exhaust performance becomes difficult. On the other hand, if the rotation number is increased in order to improve the exhaust performance without considering a measure against the stress concentration as above, a high stress is generated at the connected part between the rotating body and the rotating shaft, which lowers reliability. And since the connected part between the rotating body and the rotating shaft is a part which considerably influences reliability of the vacuum pump, a large design change of the connected part is not easy.

An object of the present invention is to provide a vacuum pump and a rotating body for the vacuum pump which can reduce stress concentration generated in the rotating body or particularly the stress generated at the connected part between the rotating body and the rotating shaft.

(1) In order to achieve the aforementioned object, the present invention is, in a vacuum pump having a rotor blade on an outer periphery of a cylinder part and including a rotating body fastened to a rotating shaft by a fastening means and rotatable together with the rotating shaft, characterized in that in the rotating body, at least one of a fitting hole portion fitted with the rotating shaft and a through hole portion, through which the fastening means penetrates, is a stress-reduction target portion, and a groove portion that reduces stress generated in the stress-reduction target portion during rotation of the rotating body is provided in the rotating body.

(2) Moreover, in order to achieve the aforementioned object, another present invention is a vacuum pump described in (1), characterized in that the groove portion is provided closer to an outer peripheral side than the fitting hole portion or the through hole portion.

(3) Moreover, in order to achieve the aforementioned object, another present invention is a vacuum pump described in (1) or (2), characterized in that the groove portion is provided on at least one of an inner peripheral surface and an outer peripheral surface of the rotating body.

(4) Moreover, in order to achieve the aforementioned object, another present invention is a vacuum pump described in any one of (1) to (3), characterized in that, in the groove portion, at least an inner peripheral side has a gentle inclination structure.

(5) Moreover, in order to achieve the aforementioned object, another present invention is a vacuum pump described in any one of (1) to (4), characterized in that the groove portion is disposed on a fastened surface of the rotating body or on an extended surface thereof.

(6) Moreover, in order to achieve the aforementioned object, another present invention is a vacuum pump described in any one of (1) to (5), characterized in that the rotating body is applied with surface treatment and has a counterbore portion, which avoids contact with the rotating shaft, on a peripheral edge part of at least one of the fitting hole portion and the through hole portion.

(7) Moreover, in order to achieve the aforementioned object, another present invention is, in a rotating body for a vacuum pump having a rotor blade on an outer periphery of a cylinder part and fastened to the rotating shaft by a fastening means, characterized in that at least one of a fitting hole portion fitted with the rotating shaft and a fastened part, to which the fastening means is fastened, is a stress-reduction target portion, the rotating body including a groove portion which reduces a stress generated in the stress-reduction target portion during rotation.

According to the present invention, the vacuum pump and the rotating body for the vacuum pump which can reduce stress generated in the connected part between the rotating body and the rotating shaft can be provided.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1:
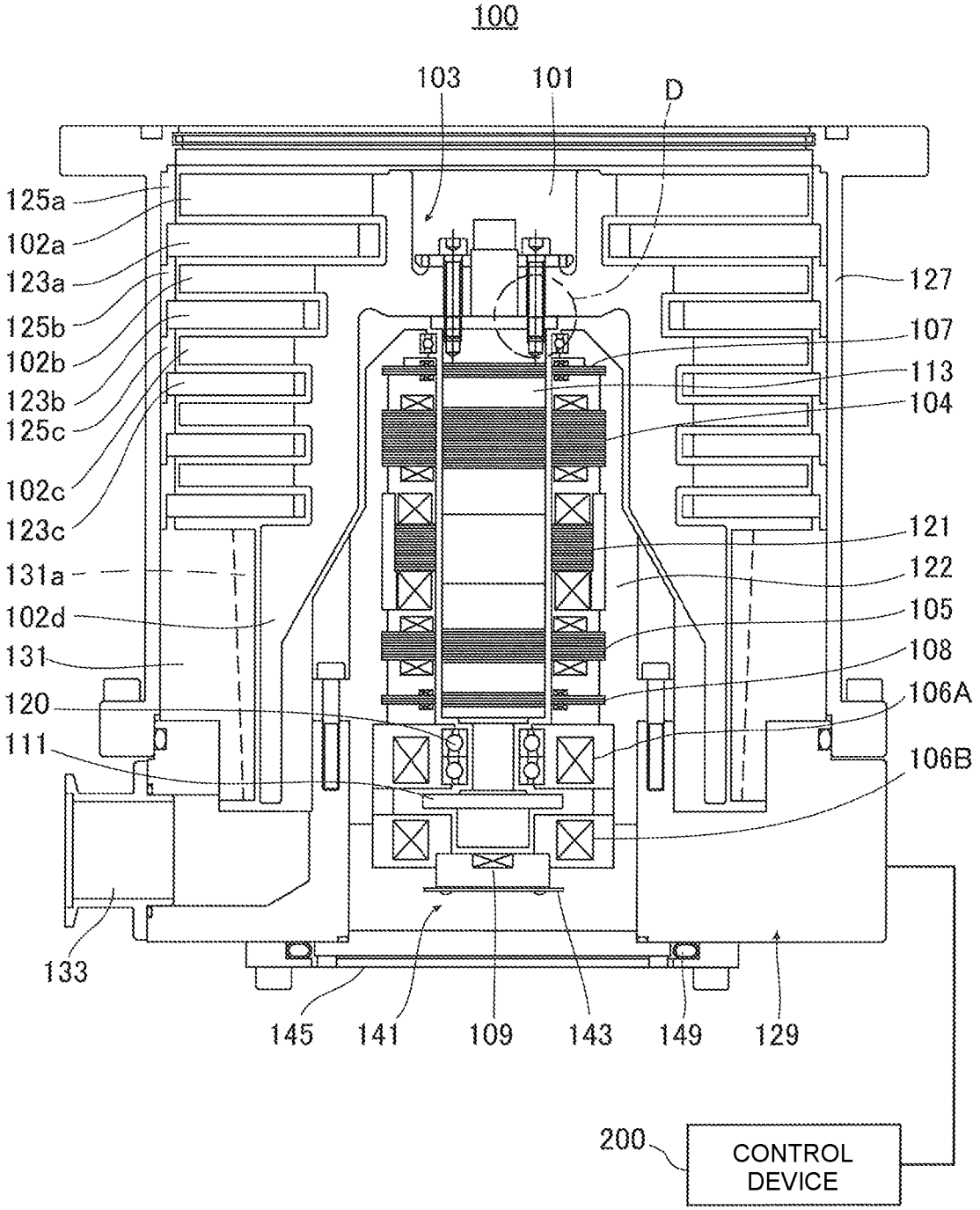
FIG. 1 is a vertical sectional view of a turbo molecular pump according to an embodiment of the present invention.

Hereinafter, a vacuum pump according to an embodiment of the present invention will be explained on the basis of the drawings. FIG. 1 illustrates a turbo molecular pump 100 as a vacuum pump according to the embodiment of the present invention. This turbo molecular pump 100 is configured to be connected to a vacuum chamber (not shown) of a target device such as a semiconductor manufacturing device, for example.

A vertical sectional view of this turbo molecular pump 100 is shown in FIG. 1. In FIG. 1, the turbo molecular pump 100 has an inlet port 101 formed in an upper end of a cylindrical outer cylinder 127. And inside the outer cylinder 127, a rotating body 103 with a plurality of rotor blades 102 (102*a*, 102*b*, 102*c*, . . . ), which are turbine blades for sucking/exhausting a gas, formed on a peripheral part radially and in multiple stages is provided. At a center of this rotating body 103, a rotor shaft 113 (rotating shaft) is mounted, and this rotor shaft 113 is floated/supported in the air and position-controlled by a magnetic bearing of 5-axis control, for example. The rotating body 103 is constituted by metal such as aluminum or an aluminum alloy in general.

Regarding an upper-side radial electromagnet 104, four electromagnets are disposed by forming a pair on an X-axis and a Y-axis. Four upper-side radial sensors 107 are provided in the vicinity of the upper-side radial electromagnets 104 and correspondingly to each of the upper-side radial electromagnets 104. As the upper-side radial sensors 107, an inductance sensor, an eddy current sensor or the like having a conductive winding is used, and a position of the rotor shaft 113 is detected on the basis of a change in inductance of this conductive winding changing in accordance with the position of the rotor shaft 113. This upper-side radial sensor 107 is configured to detect radial displacement of the rotor shaft 113, that is, the rotating body 103 fixed thereto and to send it to a control device 200.

In this control device 200, a compensation circuit having a PID adjustment function, for example, generates an excitation control-instruction signal of the upper-side radial electromagnet 104 on the basis of a position signal detected by the upper-side radial sensor 107, and an amplifier circuit 150 (which will be described later) shown in FIG. 2 excites and controls the upper-side radial electromagnet 104 on the basis of this excitation control-instruction signal, whereby an upper side radial position of the rotor shaft 113 is adjusted.

And this rotor shaft 113 is formed of a material with high magnetic permeability (such as iron and stainless) and the like and is attracted by a magnetic force of the upper-side radial electromagnet 104. Such adjustment is performed independently in each of an X-axis direction and a Y-axis direction. Moreover, a lower-side radial electromagnet 105 and a lower-side radial sensor 108 are disposed similarly to the upper-side radial electromagnet 104 and the upper-side radial sensor 107 and adjust a radial position on a lower side of the rotor shaft 113 similarly to the radial position on the upper side.

Moreover, axial electromagnets 106A, 106B are disposed by vertically sandwiching a disc-shaped metal disc 111 provided on a lower part of the rotor shaft 113. The metal disc 111 is constituted by a material with high magnetic permeability such as iron. In order to detect axial displacement of the rotor shaft 113, the axial sensor 109 is provided, and it is configured such that an axial position signal thereof is sent to the control device 200.

And in the control device 200, the compensation circuit having the PID adjustment function, for example, generates an excitation control-instruction signal for each of the axial electromagnet 106A and the axial electromagnet 106B on the basis of the axial position signal detected by the axial sensor 109, and the amplifier circuit 150 excites and controls the axial electromagnet 106A and the axial electromagnet 106B, respectively, on the basis of these excitation control-instruction signals, whereby the axial electromagnet 106A attracts the metal disc 111 upward by the magnetic force, while the axial electromagnet 106B attracts the metal disc 111 downward, and the axial position of the rotor shaft 113 is adjusted.

As described above, the control device 200 adjusts the magnetic force by which the axial electromagnets 106A, 106B affect the metal disc 111 as appropriate, magnetically floats the rotor shaft 113 in the axial direction, and holds it in a space in a non-contact manner. Note that, the amplifier circuit 150 which excites and controls the upper-side radial electromagnet 104, the lower-side radial electromagnet 105, and the axial electromagnets 106A, 106B will be described later.

On the other hand, a motor 121 includes a plurality of magnetic poles disposed in a peripheral state so as to surround the rotor shaft 113. Each of the magnetic poles is controlled by the control device 200 so as to rotate and drive the rotor shaft 113 via an electromagnetic force acting between it and the rotor shaft 113. Moreover, rotation speed sensors such as a Hall element, a resolver, and an encoder, not shown, for example, are incorporated in the motor 121 such that a rotation speed of the rotor shaft 113 is detected by a detection signal of this rotation speed sensor.

Furthermore, a phase sensor, not shown, is mounted in the vicinity of the lower-side radial sensor 108, for example, so as to detect a phase of rotation of the rotor shaft 113. The control device 200 is configured to detect a position of the magnetic pole by using the detection signals of this phase sensor and the rotation speed sensor together.

A plurality of stator blades 123 (123*a*, 123*b*, 123*c*, . . . ) are disposed with a slight gap from the rotor blades 102 (102*a*, 102*b*, 102*c*, . . . ). The rotor blades 102 (102*a*, 102*b*, 102*c*, . . . ) are formed with inclination only by a predetermined angle from a plane perpendicular to an axis of the rotor shaft 113 in order to transfer molecules of an exhaust gas downward by collision, respectively. The stator blades 123 (123*a*, 123*b*, 123*c*, . . . ) are constituted by metal such as aluminum, iron, stainless, copper, for example, or an alloy containing these metals as components.

Moreover, the stator blades 123 are also formed with inclination only by a predetermined angle from a plane perpendicular to the axis of the rotor shaft 113 similarly and are disposed alternately with stages of the rotor blades 102 toward the inside of the outer cylinder 127. And an outer peripheral end of the stator blade 123 is supported in a state fitted and inserted between a plurality of stator-blade spacers 125 (125*a*, 125*b*, 125*c*, . . . ) stacked in stages.

The stator-blade spacer 125 is a ring-shaped member and is constituted by metal such as aluminum, iron, stainless, copper, for example, or an alloy containing these metals as components. On an outer periphery of the stator-blade spacer 125, the outer cylinder 127 is fixed with a slight gap. A base portion 129 is disposed on a bottom part of the outer cylinder 127. An outlet port 133 is formed in the base portion 129 and is made to communicate with the outside. The exhaust gas entering the inlet port 101 from the chamber (vacuum chamber) side and transferred to the base portion 129 is sent to the outlet port 133.

Moreover, depending on an application of the turbo molecular pump 100, the threaded spacer 131 is disposed between the lower part of the stator-blade spacer 125 and the base portion 129. The threaded spacer 131 is a cylindrical member constituted by metal such as aluminum, copper, stainless, iron or an alloy having these metals as components, and a plurality of spiral thread grooves 131*a* are engraved in an inner peripheral surface thereof. A spiral direction of the thread groove 131*a* is a direction in which, when molecules of the exhaust gas move in a rotating direction of the rotating body 103, the molecules are transferred toward the outlet port 133. At a lowest part continuing to the rotor blades 102 (102*a*, 102*b*, 102*c*, . . . ) of the rotating body 103, a cylinder portion 102*d* is suspended. An outer peripheral surface of this cylinder portion 102*d* is cylindrical and is extended toward the inner peripheral surface of the threaded spacer 131 and is in the vicinity of the inner peripheral surface of this threaded spacer 131 with a predetermined gap. The exhaust gas having been transferred to the thread groove 131*a* by the rotor blade 102 and the stator blade 123 is sent to the base portion 129 while being guided by the thread groove 131*a*.

The base portion 129 is a disc-shaped member constituting a base part of the turbo molecular pump 100 and is constituted by metal in general such as iron, aluminum, and stainless. The base portion 129 physically holds the turbo molecular pump 100 and also functions as a heat conduction path and thus, metal with rigidity and high heat conductivity such as iron, aluminum, and copper is preferably used.

In the configuration as above, when the rotor blade 102 is rotated and driven by the motor 121 together with the rotor shaft 113, the exhaust gas is sucked from the chamber through the inlet port 101 by actions of the rotor blade 102 and the stator blade 123. A rotation speed of the rotor blade 102 is normally 20000 rpm to 90000 rpm, and a peripheral speed at a distal end of the rotor blade 102 reaches 200 m/s to 400 m/s. The exhaust gas sucked from the inlet port 101 passes between the rotor blade 102 and the stator blade 123 and is transferred to the base portion 129. At this time, a friction heat generated when the exhaust gas is brought into contact with the rotor blade 102 and conduction of the heat generated in the motor 121 raise a temperature of the rotor blade 102, and this heat is transmitted by radiation or conduction by gas molecules of the exhaust gas and the like to the stator blade 123 side.

The stator-blade spacers 125 are joined to each other on the outer peripheral parts, and the heat received by the stator blade 123 from the rotor blade 102 or the friction heat generated when the exhaust gas contacts the stator blade 123 or the like is transmitted to the outside.

Note that, in the explanation described above, the threaded spacer 131 is disposed on the outer periphery of the cylinder portion 102*d* of the rotating body 103, and the thread groove 131*a* is engraved in the inner peripheral surface of the threaded spacer 131. However, to the contrary, the thread groove is engraved in the outer peripheral surface of the cylinder portion 102*d*, and the spacer having a cylindrical inner peripheral surface is disposed in the periphery thereof in some cases.

Moreover, depending on the application of the turbo molecular pump 100, an electric component portion is covered with a stator column 122 on the periphery, and inside this stator column 122 is kept at a predetermined pressure by a purge gas in some cases so that the gas sucked from the inlet port 101 does not intrude into the electric component portion constituted by the upper-side radial electromagnet 104, the upper-side radial sensor 107, the motor 121, the lower-side radial electromagnet 105, the lower-side radial sensor 108, the axial electromagnets 106A, 106B, the axial sensor 109 and the like.

In this case, a piping, not shown, is disposed in the base portion 129, and the purge gas is introduced through this piping. The introduced purge gas is sent out to the outlet port 133 through gaps between a protective bearing 120 and the rotor shaft 113, between a rotor and a stator of the motor 121, and between the stator column 122 and the inner-peripheral side cylinder portion of the rotor blade 102.

Here, the turbo molecular pump 100 requires control based on specification of a model and individually adjusted specific parameters (characteristics corresponding to the model, for example). In order to store the control parameters, the turbo molecular pump 100 includes an electronic circuit portion 141 inside the main body thereof. The electronic circuit portion 141 is constituted by a semiconductor memory such as EEP-ROM, and electronic components such as semiconductor elements for access thereof, a board 143 for mounting them and the like. This electronic circuit portion 141 is accommodated in a lower part of a rotation speed sensor, not shown, in the vicinity of a center of the base portion 129, for example, constituting the lower part of the turbo molecular pump 100 and is closed by an airtight bottom lid 145.

By the way, in a manufacturing process of a semiconductor, some of process gases introduced into the chamber have such a nature that becomes a solid when its pressure becomes higher than a predetermined value or when its temperature becomes lower than a predetermined value. Inside the turbo molecular pump 100, a pressure of the exhaust gas is the lowest at the inlet port 101 and the highest at the outlet port 133. If the pressure of the process gas becomes higher than the predetermined value or the temperature thereof becomes lower than the predetermined value in the middle of transfer from the inlet port 101 to the outlet port 133, the process gas becomes a solid state, which adheres and deposits inside the turbo molecular pump 100.

When SiCl4 is used as the process gas in an Al etching device, for example, at a low vacuum (760 [torr] to 10-2 [torr]) and at a low temperature (approximately 20 KA it is known from a steam pressure curve that a solid product (AlCl3, for example) precipitates, adheres and deposits inside the turbo molecular pump 100. As a result, if the precipitates of the process gas deposit inside the turbo molecular pump 100, the depositions narrow a pump channel and causes lowering of performances of the turbo molecular pump 100. And the product described above was in such a state that easily solidifies and adheres at a part in the vicinity of the outlet port 133 or in the vicinity of the threaded spacer 131 where the pressure is high.

Therefore, in order to solve this problem, conventionally, a heater or an annular water-cooling pipe 149, not shown, is wrapped around an outer periphery of the base portion 129 and the like, a temperature sensor (thermistor, for example), not shown, is embedded in the base portion 129, for example, and control of heating of the heater or cooling by the water-cooling pipe 149 is executed so as to keep the temperature of the base portion 129 at a certain high temperature (set temperature) on the basis of a signal of this temperature sensor (hereinafter, called TMS. TMS: Temperature Management System).

Subsequently, regarding the turbo molecular pump 100 configured as above, the amplifier circuit 150 that excites and controls the upper-side radial electromagnet 104, the lower-side radial electromagnet 105, and the axial electromagnets 106A, 106B will be explained. A circuit diagram of this amplifier circuit 150 is shown in FIG. 2.

Figure 2:
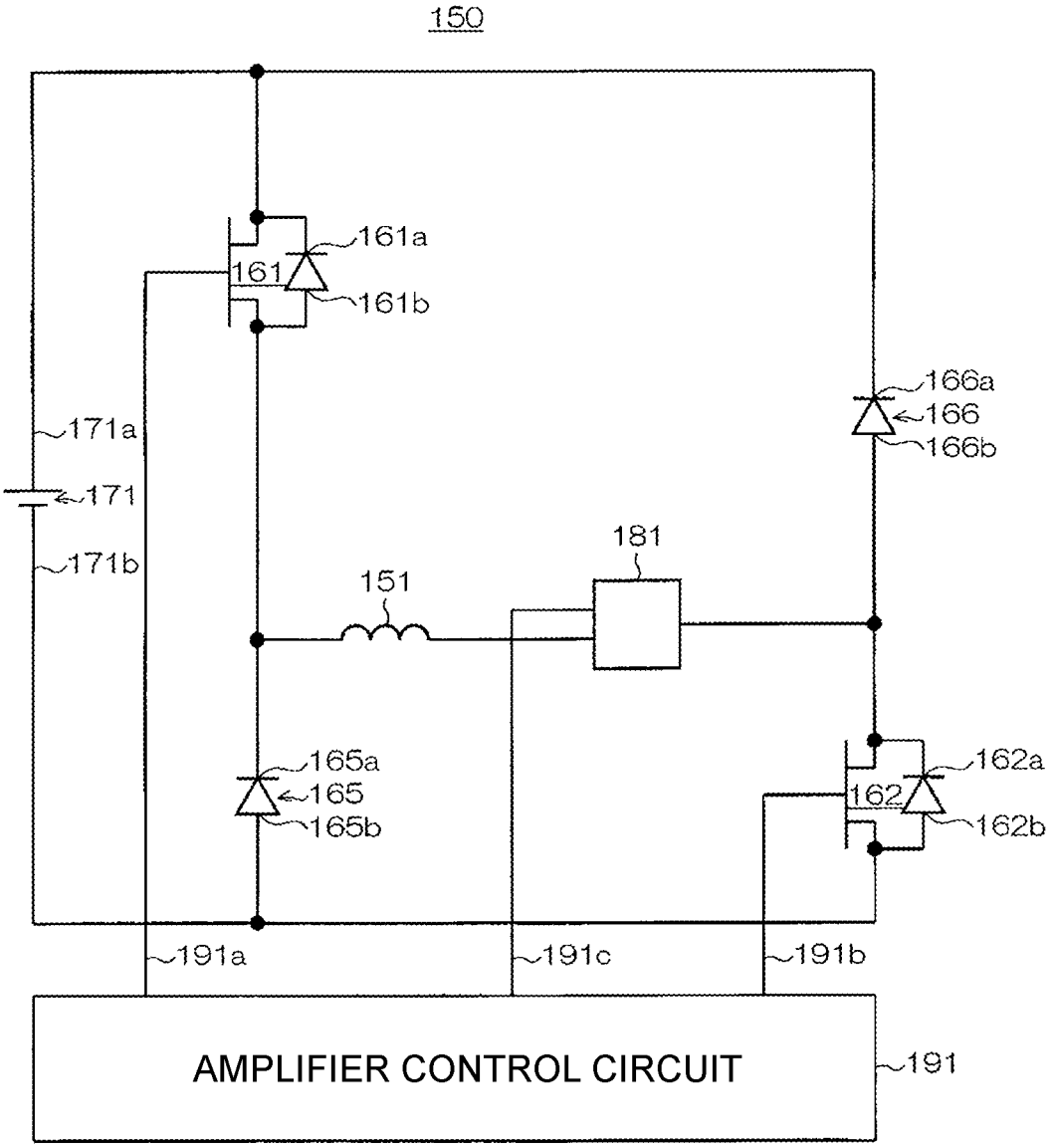
FIG. 2 is a circuit diagram of an amplifier circuit.

In FIG. 2, an electromagnet winding 151 constituting the upper-side radial electromagnet 104 and the like has one end thereof connected to a positive pole 171*a* of a power source 171 through a transistor 161 and the other end connected to a negative pole 171*b* of the power source 171 through a current detection circuit 181 and a transistor 162. And the transistors 161, 162 are so-called power MOSFET and have a structure in which a diode is connected between source-drain thereof.

At this time, the transistor 161 has a cathode terminal 161*a* of the diode thereof connected to the positive pole 171*a* and an anode terminal 161*b* connected to one end of the electromagnet winding 151. Moreover, the transistor 162 has a cathode terminal 162*a* of the diode thereof connected to the current detection circuit 181 and an anode terminal 162*b* connected to the negative pole 171*b*.

On the other hand, a diode 165 for current regeneration has a cathode terminal 165*a* thereof connected to one end of the electromagnet winding 151 and an anode terminal 165*b* thereof connected to the negative pole 171*b*. Moreover, similarly, a diode 166 for current regeneration has a cathode terminal 166*a* thereof connected to the positive pole 171*a* and an anode terminal 166*b* thereof connected to the other end of the electromagnet winding 151 through the current detection circuit 181. And the current detection circuit 181 is constituted by a Hall sensor-type current sensor or an electric resistance element, for example.

The amplifier circuit 150 constituted as above corresponds to one electromagnet. Thus, in a case where the magnetic bearing is 5-axis control and there are ten pieces in total of the electromagnets 104, 105, 106A, 106B, the similar amplifier circuit 150 is constituted for each of the electromagnets, and ten units of the amplifier circuits 150 are connected to the power source 171 in parallel.

Moreover, an amplifier control circuit 191 is constituted by a digital-signal processing portion (hereinafter referred to as a DSP portion), not shown, of the control device 200, for example, and this amplifier control circuit 191 switches on/off of the transistors 161, 162.

The amplifier control circuit 191 compares a current value detected by the current detection circuit 181 (a signal reflecting this current value is called a current detection signal 191*c*) with a predetermined current instruction value. And on the basis of this comparison result, a size of a pulse width (pulse width time Tp1, Tp2) generated within a control cycle Ts, which is one cycle by PWM control, is determined. As a result, gate drive signals 191*a*, 191*b* having this pulse width are output from the amplifier control circuit 191 to gate terminals of the transistors 161, 162.

Note that, when passing a resonant point during an acceleration operation of a rotation speed of the rotating body 103 or when disturbance occurs during a constant-speed operation and the like, position control of the rotating body 103 needs to be performed at a high speed and with a strong force. Thus, a high voltage such as 50V, for example, is used for the power source 171 so that the current flowing in the electromagnet winding 151 can rapidly increase (or decrease). Moreover, between the positive pole 171*a* and the negative pole 171*b* of the power source 171, an ordinary capacitor is connected (not shown) for stabilization of the power source 171.

In the configuration as above, when both the transistors 161, 162 are turned on, the current flowing through the electromagnet winding 151 (hereinafter, referred to as an electromagnet current iL) increases, while when the both are turned off, the electromagnet current iL decreases.

Moreover, when one of the transistors 161, 162 is turned on, while the other is turned off, a so-called flywheel current is held. And by causing the flywheel current to flow through the amplifier circuit 150 as above, a hysteresis loss in the amplifier circuit 150 is decreased, and power consumption of the circuit as a whole can be kept low. Moreover, by controlling the transistors 161, 162 as above, a high frequency noise such as a higher harmonic wave generated in the turbo molecular pump 100 can be reduced. Furthermore, by measuring this flywheel current by the current detection circuit 181, the electromagnet current iL flowing through the electromagnet winding 151 can be detected.

Figure 3:
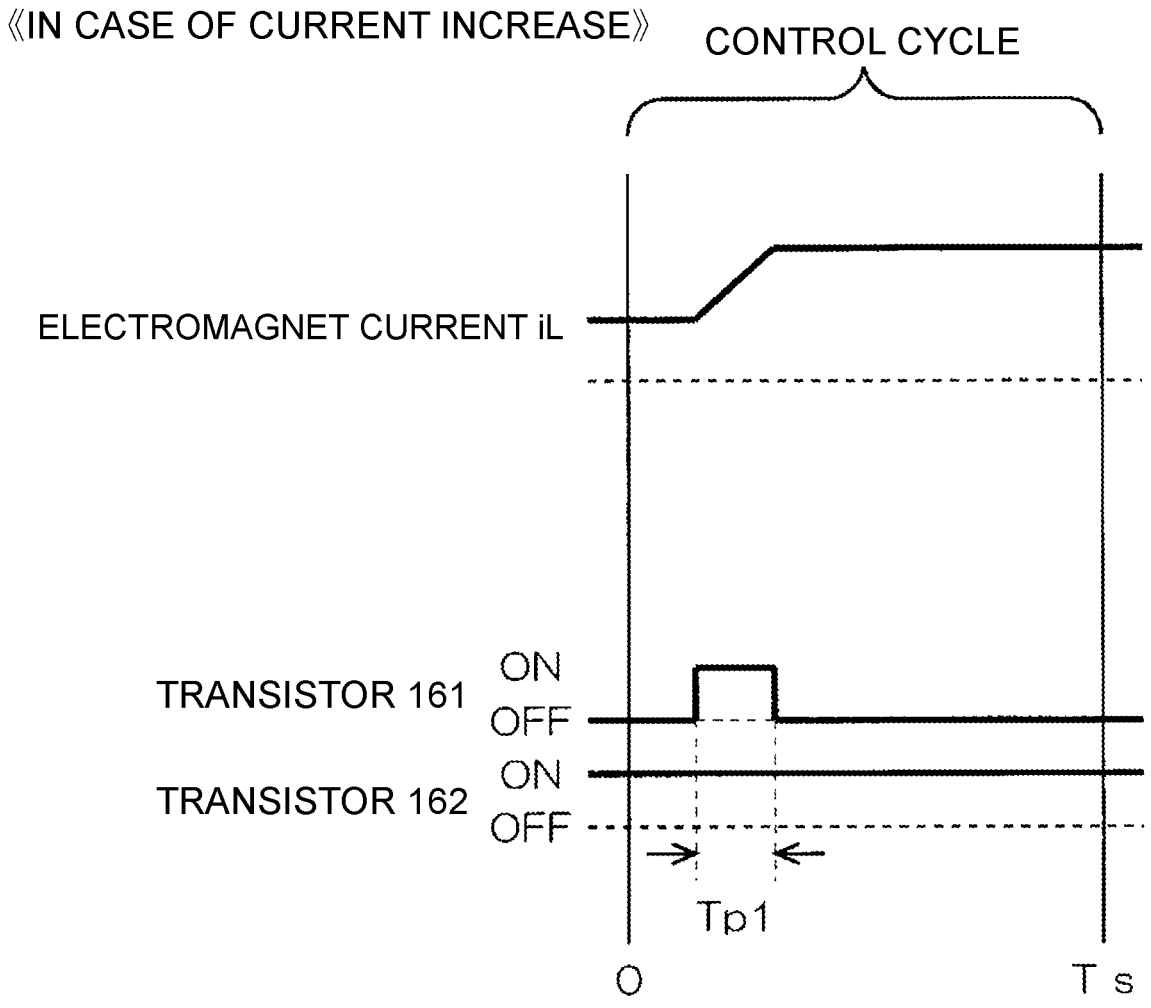
FIG. 3 is a time chart illustrating control when a current instruction value is larger than a detected value.

That is, if the detected current value is smaller than the current instruction value, both the transistors 161, 162 are turned on only for a period of time corresponding to the pulse width time Tp1 only once in the control cycle Ts (100 μs, for example) as shown in FIG. 3. Thus, the electromagnet current iL during this period increases toward a current value iLmax (not shown) that can flow from the positive pole 171*a* toward the negative pole 171*b* through the transistors 161, 162.

Figure 4:
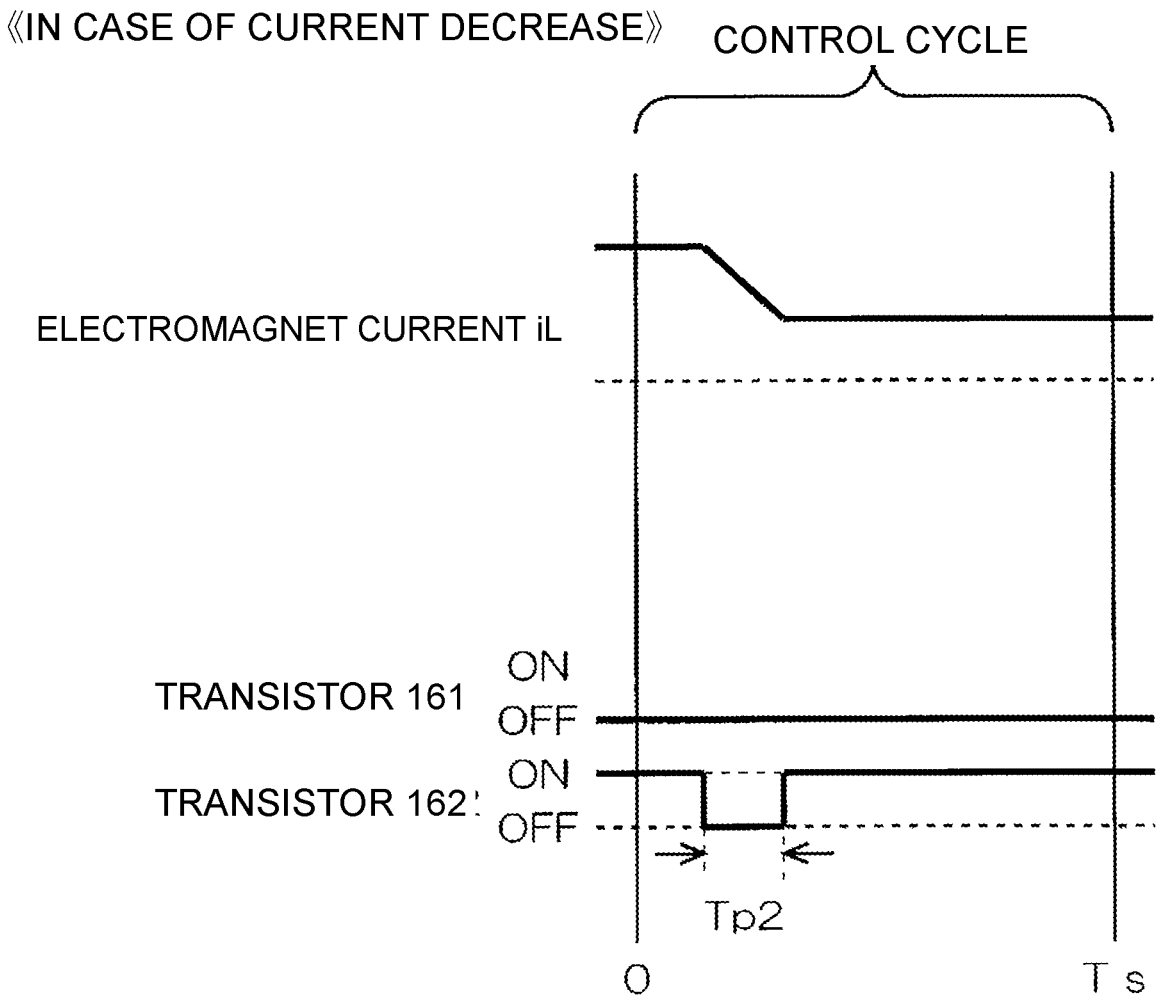
FIG. 4 is a time chart illustrating control when the current instruction value is smaller than the detected value.

On the other hand, if the detected current value is larger than the current instruction value, both the transistors 161, 162 are turned off only for a period of time corresponding to the pulse width time Tp2 only once in the control cycle Ts as shown in FIG. 4. Thus, the electromagnet current iL during this period decreases toward a current value iLmin (not shown) that can be regenerated from the negative pole 171*b* toward the positive pole 171*a* through the diodes 165, 166.

And in the both cases, after elapse of the pulse width time Tp1, Tp2, either one of the transistors 161, 162 is turned on. Thus, during this period, the flywheel current is held in the amplifier circuit 150.

In the turbo molecular pump 100 having the basic configuration as above, an upper side in FIG. 1 (the side of the inlet port 101) is a sucking portion connecting to the side of the target device, and a lower side (the side provided on the base portion 129 so that the outlet port 133 protrudes to the left side in the drawing) side is an exhaust portion connecting to an auxiliary pump (back pump for roughing), not shown, and the like. And the turbo molecular pump 100 can be used in an inverted attitude, a horizontal attitude, an inclined attitude other than a perpendicular attitude in a vertical direction as shown in FIG. 1.

Moreover, in the turbo molecular pump 100, the outer cylinder 127 described above and the base portion 129 are combined to constitute a single case (hereinafter, both are combined and called a "main-body casing" and the like in some cases). Moreover, the turbo molecular pump 100 is connected to a box-shaped electric component case (not shown) electrically (and structurally), and the electric component case incorporates the control device 200 described above.

An internal constitution of the main-body casing (combination of the outer cylinder 127 and the base portion 129) of the turbo molecular pump 100 can be separated into a rotation mechanism portion that rotates the rotor shaft 113 and the like by the motor 121 and an exhaust mechanism portion rotated/driven by the rotation mechanism portion. Moreover, the exhaust mechanism portion can be considered separately as a turbo-molecular-pump mechanism portion constituted by the rotor blade 102, the stator blade 123 and the like and a groove-exhaust mechanism portion (which will be described later) constituted by the cylinder portion 102*d*, the threaded spacer 131 and the like.

Moreover, the purge gas (protective gas) described above is used for protection of the bearing part, the rotor blade 102 and the like and prevents corrosion caused by the exhaust gas (process gas) and cools the rotor blade 102 and the like. Supply of this purge gas can be performed by a general method.

For example, though not shown, a purge gas channel extending linearly in the radial direction is provided at a predetermined part (a position separated approximately by 180 degrees with respect to the outlet port 133 and the like) of the base portion 129. And to this purge gas channel (more specifically, a purge port to be an inlet of the gas), a purge gas is supplied via a purge-gas bomb (N2 gas bomb or the like), a flow-rate controller (valve device) and the like from the outer side of the base portion 129.

The aforementioned protective bearing 120 is also called a "touchdown (T/D) bearing", "backup bearing" and the like. By means of these protective bearings 120, even in the case of a trouble in an electric system or a trouble such as atmospheric entry or the like, for example, a position or an attitude of the rotor shaft 113 is not largely changed, or the rotor blade 102 or its peripheral part is not damaged.

Note that, in each of the drawings (FIG. 1, FIGS. 5 to 10, FIG. 13, FIG. 14) showing the structure of the turbo molecular pump 100, depiction of hatching illustrating a section of a component is omitted in order to avoid complexity of the drawings.

Figure 5:
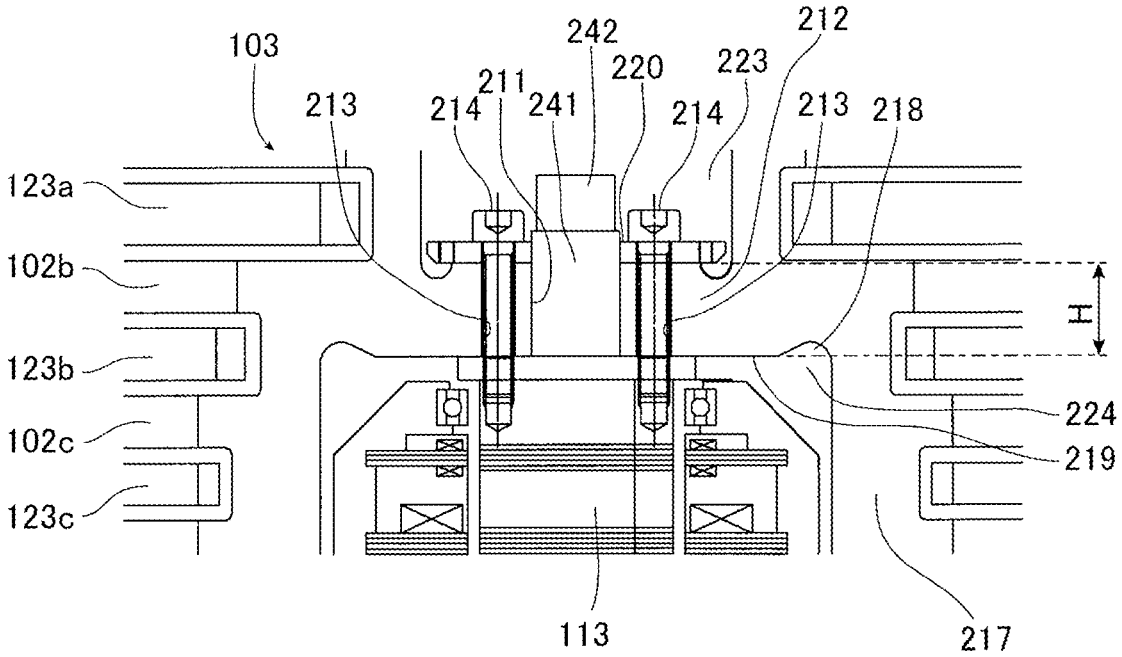
FIG. 5 is a vertical sectional view illustrating a part of FIG. 1 in an enlarged manner.

Subsequently, a stress distribution function and the like of the rotating body 103 described above will be explained. As described above, the rotor shaft 113 is mounted at the center of the rotating body 103. The rotating body 103 has a disc portion 212 having a fitting hole 211 at the center as shown in FIG. 5 in an enlarged manner, and the fitting shaft portion 241 of the rotor shaft 113 is fitted in a fitting hole 211.

On one end part in the axial direction of the rotor shaft 113 (upper end part in FIG. 1 and FIG. 5, here), a relatively small-diameter protruding end portion 242 and the aforementioned fitting shaft portion 241 are formed. The protruding end portion 242 and the fitting shaft portion 241 are formed with diameters different from each other, and the diameter of the fitting shaft portion 241 is larger than the diameter of the protruding end portion 242.

Furthermore, the fitting shaft portion 241 and the protruding end portion 242 constitute a stepped shape. And the fitting shaft portion 241 is coaxially inserted into the fitting hole 211 of the rotating body 103 and is brought into contact with an inner peripheral surface of the fitting hole 211 with a pressure generated by a predetermined method (here, quenching). Though not shown clearly, a length in the axial direction acting as the fitting part of the fitting shaft portion 241 substantially matches a thickness H of the disc portion 212 shown in FIG. 5. Moreover, the protruding end portion 242 of the rotor shaft 113 is located outside the disc portion 212 of the rotating body 103.

In the disc portion 212 of the rotating body 103, a plurality of (6 spots or 8 spots, for example) bolt through holes 213 are formed and disposed in the periphery of the fitting hole 211. In the bolt through holes 213, a bolt 214 (fastening means) such as a bolt with a hexagonal hole or the like is inserted. These bolts 214 are threaded into the rotor shaft 113. And the rotating body 103 and the rotor shaft 113 are coupled with each other by a fastening force of the bolt 214.

Figure 6:
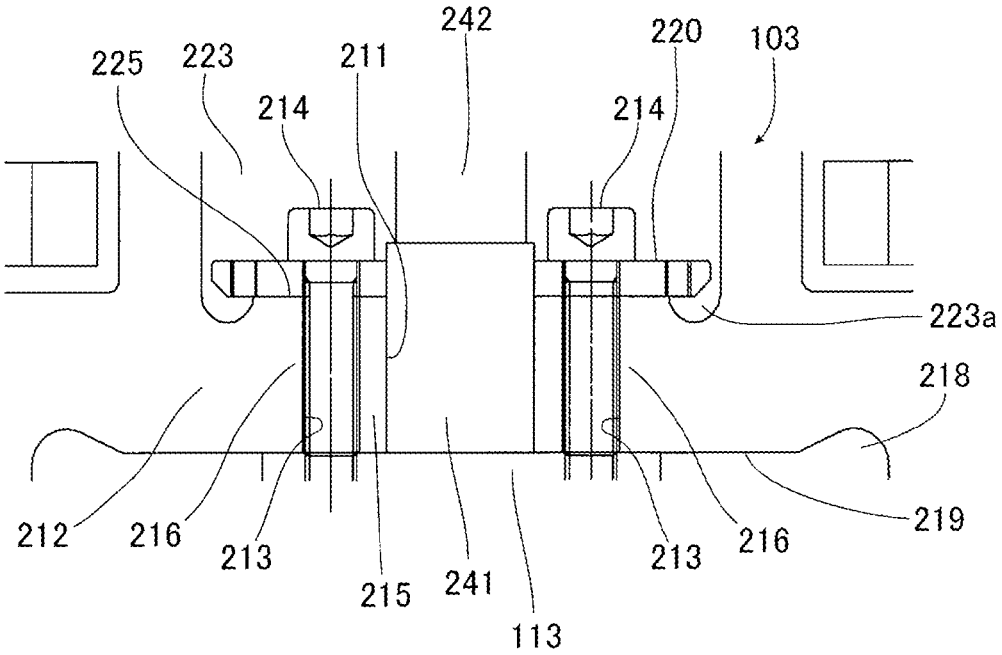
FIG. 6 is a vertical sectional view illustrating a part of FIG. 5 in an enlarged manner.

In the following, as shown in FIG. 6, the fitting hole 211 and the parts around the fitting hole 211 in the disc portion 212 of the rotating body 103 are assumed to be a fitting hole portion 215 (stress-reduction target portion). Moreover, the bolt through hole 213 and the part around the bolt through hole 213 in the disc portion 212 are assumed to be a through hole portion 216 (similarly, the stress-reduction target portion). Moreover, when the fitting hole portion 215 and the through hole portion 216 are adjacent to each other, an area where the fitting hole portion 215, which is the stress-reduction target portion, and the through hole portion 216, which is the stress-reduction target portion, overlap each other is assumed to be generated. And the overlap area in this case is also assumed to be the stress-reduction target portion. Here, in this embodiment, the explanation is made such that the fitting hole portion 215 includes the fitting hole 211, and the through hole portion 216 includes the bolt through hole 213, but this is not limiting, and it may be configured such that the fitting hole portion 215 does not include the fitting hole 211, and the through hole portion 216 does not include the bolt through hole 213.

Moreover, between the disc portion 212 and the head part of the bolt 214, a disc-shaped and annular washer 220 is sandwiched. Furthermore, on an outer peripheral part on the bottom part in the recessed portion 223 in which the washer 220 is disposed in the disc portion 212, as shown in FIG. 6, a groove portion (groove portion in recessed portion) 223*a* facing a plate surface of the washer 220 is formed. Moreover, though reference numerals are omitted, a plurality of through holes capable of preventing collecting of a gas between the disc portion 212 and itself is formed in the washer 220.

On the outer peripheral part of the disc portion 212 in the rotating body 103, as shown in FIG. 5, a rotor-blade forming portion 217 (cylinder part) is integrally formed continuously. This rotor-blade forming portion 217 is integrally formed continuously also on the cylinder portion 102*d* described above of the rotating body 103. Moreover, at a boundary part 224 between disc portion 212 and the rotor-blade forming portion 217, a groove portion 218 is formed.

This groove portion 218 is formed in an inner peripheral surface 219 of the disc portion 212 and is opened in the inner peripheral surface 219. Moreover, in this embodiment, the groove portion 218 extends over the entire circumference of the inner peripheral surface 219 and has a constant sectional shape over the entire circumference. Note that the invention according to this embodiment is not limited to the formation of the groove portion 218 over the entire circumference of the inner peripheral surface 219, but the groove portion 218 may be formed so as to be intermittently disposed along the peripheral direction of the inner peripheral surface 219.

Figure 7:
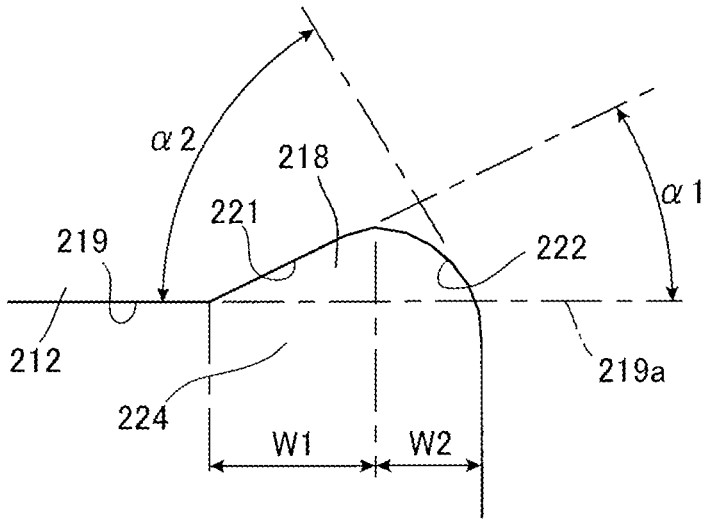
FIG. 7 is an explanatory view illustrating a groove portion in the turbo molecular pump in FIG. 1 in an enlarged manner.

The groove portion 218 has, as shown in FIG. 7, an inclined portion 221 and a curved portion 222. The inclined portion 221 in them is inclined so as to be deeper from a center side toward an outer peripheral side of the rotating body 103, and the curved portion 222 is curved in an arc shape so as to become shallow from the center side toward the outer peripheral side of the rotating body 103. Furthermore, the inclined portion 221 is positioned on the center side of the rotating body 103, and the curved portion 222 is positioned on the outer peripheral side of the inclined portion 221.

The inclined portion 221 is formed at a part adjacent to the inner peripheral surface 219 of the disc portion 212 and continues from the inner peripheral surface 219 via an inclination angle $\alpha 1$ with the inner peripheral surface 219 as a reference. Moreover, the inclination angle $\alpha 1$ is substantially constant from the inner peripheral side to the outer peripheral side of the inclined portion 221. Note that this is not limiting, and the inclination angle of the inclined portion 221 may be configured to be changed in the middle from the inner peripheral side toward the outer peripheral side.

The curved portion 222 is formed so as to have a tangent angle of $\alpha 2$ with the inner peripheral surface 219 of the disc portion 212 as a reference. In FIG. 7, the tangent angle $\alpha 2$ is an angle of a tangent at a position where the curved portion 222 intersects an extension 219*a* of the inner peripheral surface 219. Moreover, the inclination angle $\alpha 1$ and the tangent angle $\alpha 2$ have a relationship of $\alpha 1 < \alpha 2$. That is, in a relationship between the tangent angle $\alpha 2$ and the inclination angle $\alpha 1$ in the groove portion 218, the inclination angle $\alpha 1$ has a gentler inclination structure as compared with the tangent angle $\alpha 2$, and the tangent angle $\alpha 2$ has a larger and steeper inclination structure than the inclination angle $\alpha 1$.

Moreover, the inclination angle $\alpha 1$ preferably has an acute-angle structure ($\alpha < 45$ degrees).

In the turbo molecular pump 100 having the rotating body 103 as above, the more the rotation number of the rotating body 103 is raised, the higher the exhaust performance becomes. However, when the rotating body 103 is designed, a shape and a dimension of each part need to be determined so that an excessive stress is not generated by a centrifugal force during rotation.

Moreover, spots where the stress concentration can easily occur in the rotating body 103 include the connected part between the rotating body 103 and the rotor shaft 113. And the connected part between the rotating body 103 and the rotor shaft 113 includes the through hole portion 216 around the bolt through hole 213 and the fitting hole portion 215 around the fitting hole 211.

If the stress generated in these spots can be reduced and an excessive rise of the stress generated in other spots can be prevented, strength of the rotating body 103 and the reliability of the turbo molecular pump 100 are improved. Moreover, since a room for the stress generation can be increased, the rotation number of the rotating body 103 can be raised, and the exhaust performance of the turbo molecular pump 100 can be improved.

From these viewpoints, the inventor and the like have made researches on the stress reduction in the through hole portion 216 and the fitting hole portion 215 and acquired an idea of purposely adding an irregular part to the disc portion 212 in the rotating body 103 so as to increase the stress generated in the disc portion 212. And by forming the groove portion 218 as described above as the irregular part, the stress generated in the parts in the vicinity of the through hole portion 216 and the fitting hole portion 215 can be increased. As a result, the stress can be distributed in the rotating body 103 (particularly in the disc portion 212), the stress in the through hole portion 216 and the fitting hole portion 215 can be reduced, and reliability and performances of the turbo molecular pump 100 can be improved.

Moreover, the inventor and the like conducted simulations for a structural model in which the groove portion 218 is formed in the rotating body 103 and experiments using an actual one, the stress generated in the through hole portion 216 and the fitting hole portion 215 was actually lowered. It can be considered that the groove portion 218 forms a so-called "escape" of the stress, and the stress was averaged.

Moreover, even if the stress generated in the through hole portion 216 and the fitting hole portion 215 can be reduced as described above, an excessive stress in the groove portion 218 is not preferable. Furthermore, excessive increases in the number of processes and costs for machining the rotating body 103 by providing the groove portion 218 are not preferable, either. Thus, the inventor and the like examined the optimal shape and machining method for the groove portion 218 and reached the conclusion that such a shape is preferable that the inclined portion 221 that inclines gently is disposed on the inner peripheral side and that a relatively steep part (the curved portion 222, here) is disposed on the outer peripheral side. By forming the groove portion 218 having the shape as above on the rotating body 103, the stress distribution can be distributed more averagely.

Figure 9:
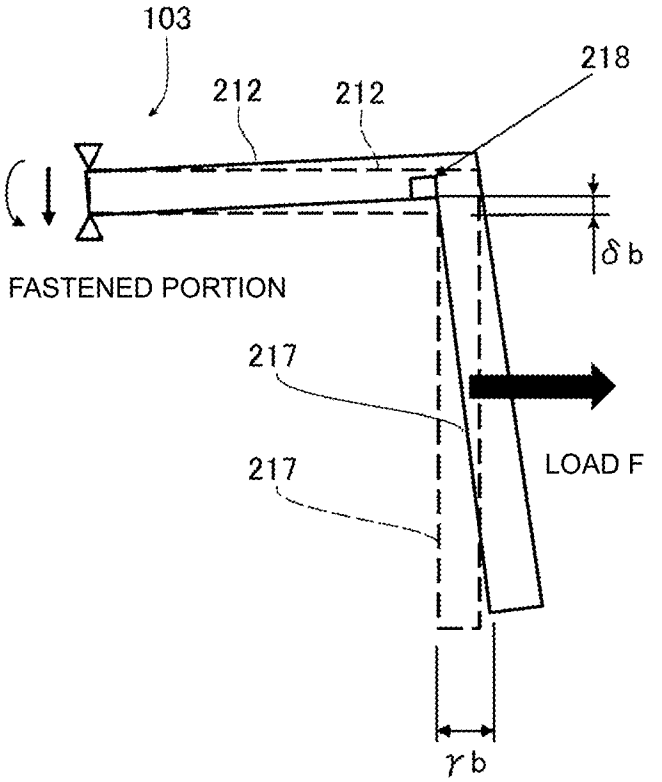
FIG. 9(*a*) is an explanatory diagram illustrating deflection of a rotating body when the groove portion is not provided, and FIG. 9(*b*) is an explanatory diagram illustrating the deflection of the rotating body when the groove portion is provided.
Figure 9:
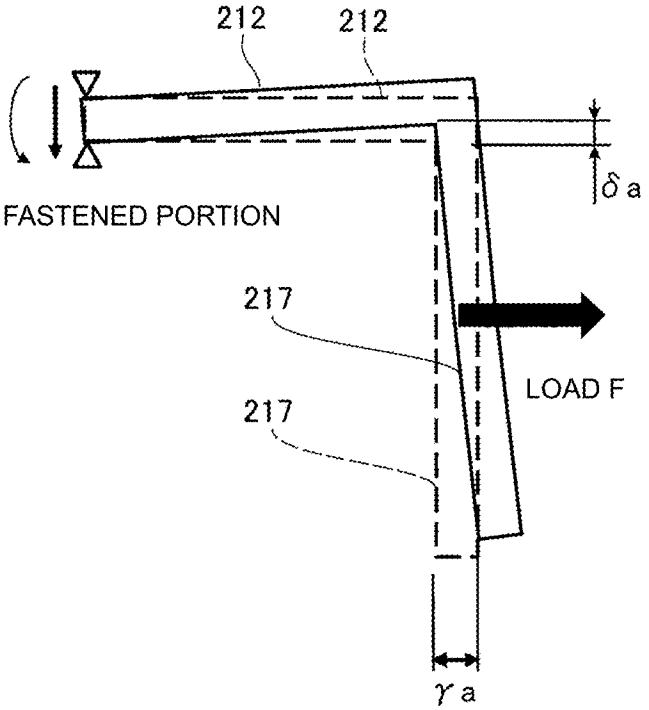

FIG. 9(*a*) models and schematically illustrates deformation at rotation of the rotating body 103 in the case where the groove portion 218 is not provided (conventional structure). Moreover, FIG. 9(*b*) similarly models and illustrates the deformation at the rotation of the rotating body 103 in the case where the groove portion 218 is provided. At the rotation of the rotating body 103, a centrifugal force acts on the rotating body 103, and a load F acts on the rotor-blade forming portion 217 to the outer peripheral side. Moreover, on the connected part between the rotating body 103 and the rotor shaft, a moment by the load F acts.

And the rotating body 103 is deformed with the fastened part with the rotor shaft 113 (here, it is considered as the through hole portion 216) as a fulcrum, and the closer it gets from the fulcrum toward the outer peripheral side, the larger it is deflected and displaced to the sucking side (Upper sides in FIGS. 9(*a*), 9(*b*)). In FIGS. 9(*a*), 9(*b*), it is assumed that displacement amounts in the axial direction on the outer peripheral side of the disc portion 212 are $\delta a$, $\delta b$, respectively, and displacement amounts in the radial direction on the exhaust side in the rotor-blade forming portion 217 (lower sides in FIGS. 9(*a*), 9(*b*)) are γa, γb.

When the groove portion 218 is provided as shown in FIG. 9(*b*), in the displacement amounts δa, δb of the disc portion 212, δb becomes smaller than δa for the reason described below. In the displacement amounts γa, γb of the rotor-blade forming portion 217 whose lower side is not restricted, γb becomes larger than γa. That is, in the case of FIG. 9(*b*) in which the groove portion 218 is provided, the stress generated in the vicinity of the groove portion 218 becomes higher than the case of FIG. 9(*a*) in which the groove portion 218 is not provided, and the deformation of the rotor-blade forming portion 217 becomes larger on the outer peripheral side than the groove portion 218. And the stress corresponding to a part by which the deformation amount increases is generated on and around the groove portion 218, and the stress caused by the load F is distributed not only to the fastened part (fulcrum) but also to the groove portion 218.

And by distributing the stress caused by the load F to the groove portion 218, the stress generated at the fastened part (fulcrum) can be reduced. And by keeping the stress generated in the groove portion 218 appropriate and by preventing the excessive rise of the stress generated in the groove portion 218, the strength of the rotating body 103 and the reliability of the turbo molecular pump 100 are improved as a whole. Moreover, since a room for stress generation can be increased, the rotation number of the rotating body 103 can be raised, and the exhaust performance of the turbo molecular pump 100 can be improved.

Figure 10:
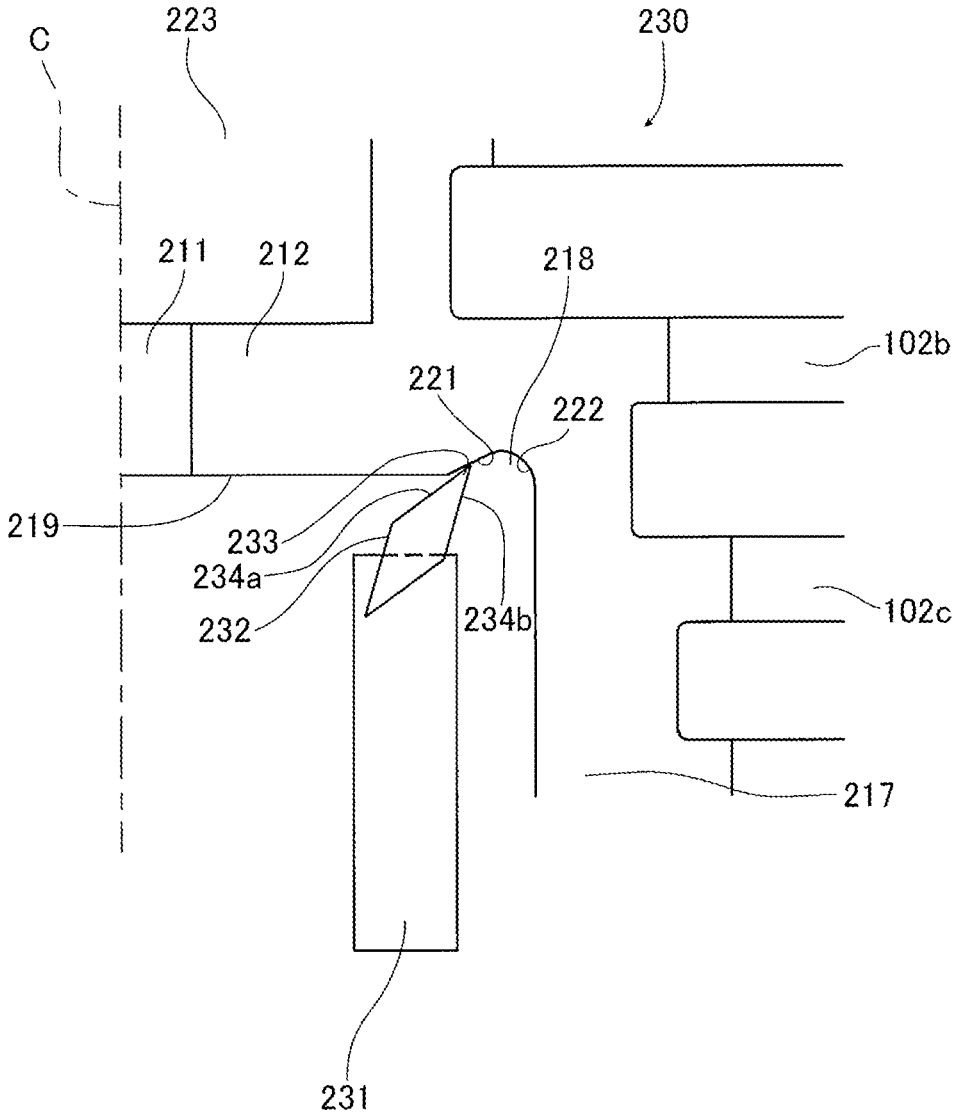
FIG. 10 is an explanatory diagram schematically illustrating a state of a work when the groove portion is fabricated.

Subsequently, when the groove portion 218 as above is to be fabricated, a work as shown in FIG. 10 can be performed. For example, while a base material 230 of the rotating body 103 is rotated around a shaft center, a cutting tool (cutting tool) 231 is made to advance to the inner peripheral side of the base material 230. Here, what is indicated by a reference character C in FIG. 10 is the shaft center of the base material 230, and at the fabrication of the groove portion 218, the base material 230 is rotated around this shaft center C. In FIG. 10, only a part of the half in the base material 230 is shown with the shaft center C as a boundary.

At a distal end of the cutting tool 231, a tip (blade edge) 232 for lathe is mounted. At the distal end of the tip 232, cutting-edge surfaces 234*a*, 234*b* are formed by sandwiching an angle portion 233. The tip 232 is mounted on the cutting tool 231 with the distal end side directed to the outer peripheral side (outer side in the radial direction) of the disc portion 212 in the base material 230.

The cutting tool 231 performs forward/backward movement along the shaft center C of the base material 230 or vertical/lateral movement on an orthogonal plane to the shaft center C by a feeding mechanism, not shown. And the tip 232 is brought into contact with the base material 230 in a state where the one cutting-edge surface 234*a* diagonally directed to the inner peripheral side (inner side in the radial direction) and gradually cuts the rotating base material 230 while performing the forward/backward movement and the vertical/lateral movement as necessary. The cutting tool 231 is guided so that the closer the tip 232 goes to the outer peripheral side, the deeper it cuts the base material 230, whereby the inclined portion 221 is formed.

Moreover, the cutting tool 231 is made to go backward with respect to the disc portion 212 while moving to the outer peripheral side. And the tip 232 moves so as to reach the side of the rotor-blade forming portion 217 from the disc portion 212, whereby the curved portion 222 is formed. The movement of the cutting tool 231 as above is performed in a narrow width in the radial direction as compared with the formation of the inclined portion 221. As a result, between the inclined portion 221 and the curved portion 222, as shown in FIG. 7, a width in the radial direction (width of an annular part) W1 in the inclined portion 221 becomes larger than a width in the radial direction (width of the same annular part) W2 in the curved portion 222.

As described above, by setting the inclination angle α1 related to the inclined portion 221 smaller than the tangent angle α2 related to the curved portion 222, the groove portion 218 can be formed as smoothly as possible. Moreover, at a part on the outer peripheral side of the disc portion 212, the base material 230 can be machined by disposing the cutting tool 231 closer to the inner peripheral side, which is the side where there is no rotor-blade forming portion 217.

And the fabrication of the groove portion 218, the space (inner space) on the inner peripheral surface side of the base material 230 can be effectively utilized. Moreover, such machining can be realized that the tip 232 does not interfere with the rotor-blade forming portion 217. As a result, when the groove portion 218 is fabricated, such a work of changing a direction of the cutting tool 231 is not necessary any more, and the groove portion 218 can be fabricated easily with a smaller number of processes. Moreover, the groove portion 218 can be fabricated with the general cutting tool 231 without preparing a dedicated tool.

Figure 11:
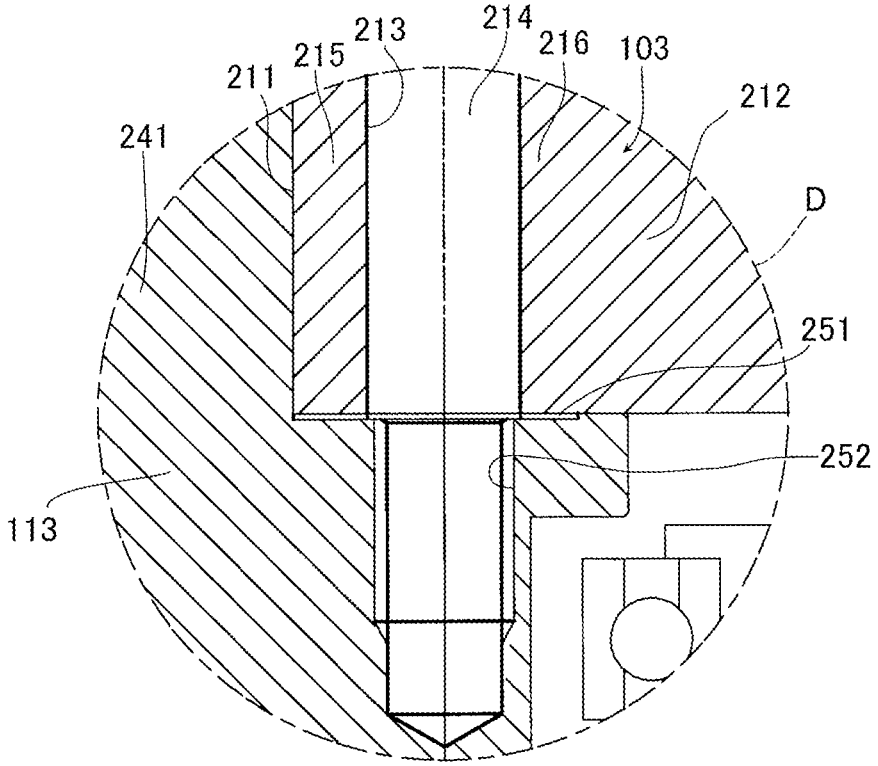
FIG. 11 is a vertical sectional view illustrating a stress-control recess portion formed in a part surrounded by a circle D in FIG. 1 in an enlarged manner.

Subsequently, a stress control function exerted between the rotating body 103 and the rotor shaft 113 will be explained. FIG. 11 illustrates a part surrounded by a one-dot chain line circle D in FIG. 1 in an enlarged manner. Here, in FIG. 11, the fitting shaft portion 241 of the rotor shaft 113 is not cut vertically but a part on the lower side in the figure of the fitting shaft portion 241 is cut vertically.

In the example in FIG. 11, at a root part in the fitting shaft portion 241 of the rotor shaft 113, a stress-control recess portion 251 (counterbore portion) is formed. This stress-control recess portion 251 is formed with a certain depth (approximately 0.1 to 0.5 mm, for example) by counterboring an opening portion of a female screw portion 252 into which the bolt 214 is screwed in the periphery of the root part in the fitting shaft portion 241. Moreover, the stress-control recess portion 251 is formed so as to face a peripheral edge part of the opening portion of the bolt through hole 213 in the rotating body 103.

This stress-control recess portion 251 is configured to receive a protruding portion (not shown), if it is present on a surface opposed to the rotating body 103 and the rotor shaft 113, in a space in the inner side so that the opposed surface does not contact (is not contacted) or press the protruding portion. And the stress-control recess portion 251 prevents the stress generated in the disc portion 212 from increasing by application of a stress generated in the protruding portion or a contact surface with the protruding portion.

As a result, collapse of a relationship between the stress generated in the fitting hole portion 215 or the through hole portion 216 and the stress generated in the groove portion 218 by the pressing of the protruding portion can be prevented. And the stress distribution function of the groove portion 218 is exerted as designed without being affected by the pressing of the protruding portion. Moreover, by providing the stress-control recess portion 251, the stress distribution function by the groove portion 218 can be made to function more reliably.

Here, as the protruding portion, a substance generated after applying surface processing (electroless nickel plating or the like) (so-called plating drip) to the inner peripheral surfaces of the fitting hole 211 and the bolt through hole 213 for improving resistance against an erosive gas, unexpected protruding part generated on the fitting hole portion 215 and the through hole portion 216 and the like can be exemplified. And even if the protruding portion as above is generated at a part close to the fitting hole 211 or the bolt through hole 213, by preventing or suppressing stress generation by the stress-control recess portion 251, the function of the groove portion 218 can be exerted to the maximum.

Figure 12:
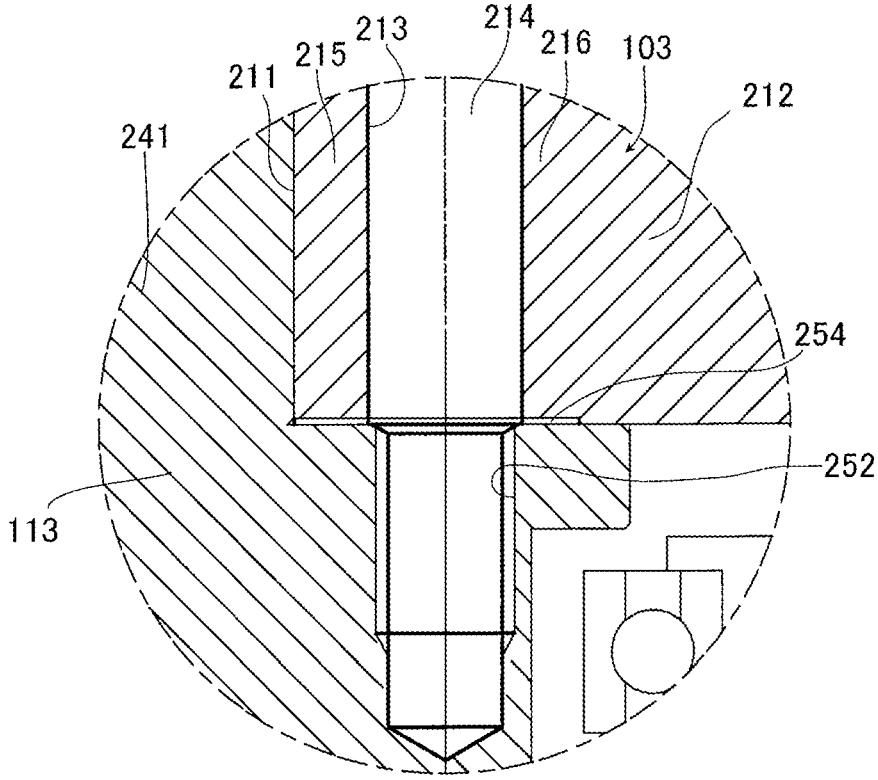
FIG. 12 is a vertical sectional view illustrating a variation of the stress-control recess portion.

Note that, in FIG. 11, the example in which the stress-control recess portion 251 is provided on the rotor shaft 113 is illustrated, but this is not limiting, and as shown in FIG. 12, the stress-control recess portion 254 (counterbore) may be provided on the side of the rotating body 103, for example. In the example in FIG. 12, by counterboring the opening portion of the bolt through hole 213, it is formed with a certain depth (approximately 0.1 to 0.2 mm, for example). If the stress-control recess portion 254 is formed on the side of the rotating body 103 as above, the working effects of the invention similar to that in the example in FIG. 11 can be exerted.

As components forming the stress-control recess portions 251, 254, a component on the side where the protruding part is not generated (or difficult to be generated) can be considered. For example, in the rotating body 103 and the rotor shaft 113, since the rotor shaft 113 is rarely plated, the stress-control recess portion 251 may be formed on the rotor shaft 113.

According to the turbo molecular pump 100 of this embodiment as described above, the stress on the through hole portion 216 and the fitting hole portion 215 can be distributed by the groove portion 218 provided on the rotating body 103 at rotation of the rotating body 103. Thus, the stress that can be generated in the through hole portion 216 and the fitting hole portion 215 is increased and as a result, reliability and performances of the rotating body 103 and the turbo molecular pump 100 can be improved.

The averaging of the stress by the groove portion 218 does not change energy relating to the stress generated in the through hole portion 216, the fitting hole portion 215, and the rotating body 103 as a whole. However, if the groove portion 218 is not provided, stress at a part where stress exceeding the average could be generated can be lowered.

Moreover, the groove portion 218 has the inclined portion 221 with the inclination angle $\alpha 1$ and the curved portion 222 with the tangent angle $\alpha 2$, and the inclination angle $\alpha 1$ and the tangent angle $\alpha 2$ have the relationship of $\alpha 1<\alpha 2$. And it can be also described that the inclined portion 221 is gentler than the curved portion 222, and the curved portion 222 is steeper than the inclined portion 221. Thus, the stress can be distributed appropriately for the through hole portion 216 and the fitting hole portion 215 by the gentle inclined portion 221 and the steep curved portion 222.

Note that the both inclination angle $\alpha 1$ and the tangent angle $\alpha 2$ can similarly have gentle angles. In that case, the similar stress distribution can be generated in the both inclined portion 221 and the curved portion 222. On the other hand, by causing the curved portion 222 to have a structure steeper than that of the inclined portion 221 as described above, the radial width (width of the annular part) W2 in the curved portion 222 can be made smaller.

Moreover, in the example in FIG. 7, since the inclined portion 221 is formed on the inner peripheral side away from the rotor-blade forming portion 217, and the curved portion 222 is formed on the outer peripheral side close to the rotor-blade forming portion 217, the internal space of the base material 230 can be effectively utilized at machining of the inclined portion 221, and the groove portion 218 can be machined while preventing interference of the base end side of the tip 232 in the cutting tool 231 with the rotor-blade forming portion 217. And the machining of the groove portion 218 can be performed with a lower cost.

Figure 8:
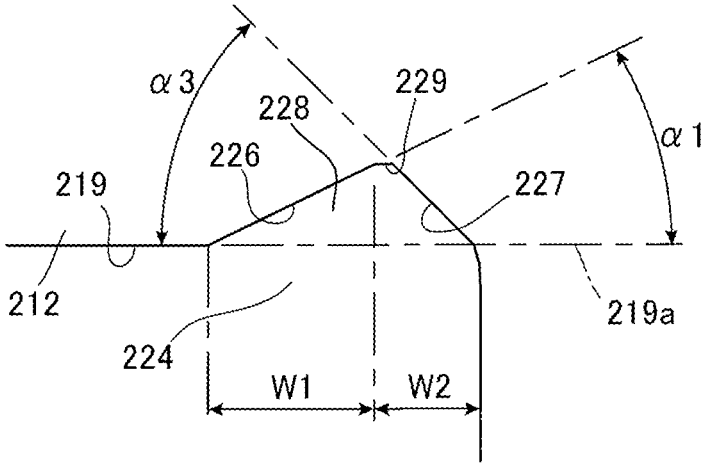
FIG. 8 is an explanatory view illustrating a variation of the groove portion.

Here, in the example in FIG. 7, the sectional shape of the groove portion 218 is constituted by combining the inclined portion 221 and the curved portion 222, but this is not limiting, and a groove portion 228 may be formed by combining a first inclined portion 226 and a second inclined portion 227 as shown in FIG. 8, for example. In the example in FIG. 8, the first inclined portion 226 is formed similarly to the inclined portion 221 in the example in FIG. 7, but the second inclined portion 227 is constituted not by an arc-shaped surface but a substantially flat inclined surface with an inclination angle $\alpha 3$. Moreover, in the example in FIG. 8, the first inclined portion 226 and the second inclined portion 227 continue to each other through a connecting curved-surface portion 229 having an arc-shaped sectional shape.

In the example in FIG. 8, too, it can be described that the first inclined portion 226 on the inner peripheral side is gentler than the second inclined portion 227 on the outer peripheral side and that the second inclined portion 227 is steeper than the first inclined portion 226. And the groove portion 228 can be machined while effectively utilizing the internal space of the base material 230.

The embodiment of the present invention has been explained as above, but the present invention is not limited to the aforementioned embodiment but is capable of various variations. For example, the disposition of the groove portion 218 is not limited to the boundary part 224 with respect to the rotor-blade forming portion 217 in the disc portion 212 as shown in FIG. 5, but it may be disposed on any of parts closer to the inner peripheral side than the boundary part 224 (part on the outer peripheral side of the fitting hole portion 215 or the through hole portion 216 and on the inner peripheral side of the boundary part 224). Moreover, a plurality of the groove portions 218 may be provided in a space between the boundary part 224 and the fitting hole 211.

Moreover, the groove portion 218 can be provided on at least either one of the inner peripheral surface and the outer peripheral surface of the rotating body 103. And the disposition of the groove portion 218 can be configured such that it is opened in the outer peripheral surface of the rotating body 103. As the outer peripheral surface of the rotating body 103, an outer peripheral surface 225 of the disc portion 212 can be exemplified. Moreover, as the inner peripheral surface and the outer peripheral surface of the rotating body, the inner peripheral surface and the outer peripheral surface of the cylinder portion 102*d* (FIG. 1) closer to the exhaust side than the rotor blade 102 in the rotating body 103 can be cited. Furthermore, regarding distinction between the inner peripheral surface and the outer peripheral surface of the rotating body 103, a surface facing the internal space of the rotating body 103 can be distinguished as the inner peripheral surface from the other as the outer peripheral surface, for example.

Here, the stress distribution function by the groove portion 218 is considered to be exerted more easily by disposing the groove portion 218 closer to the outer peripheral side of the connected part (the fitting hole portion 215 and the through hole portion 216) between the rotating body 103 and the rotor shaft 113 and a part closer to the connected part. And as the part as above, in the example of FIG. 5, a part closer to the outer peripheral side than the through hole portion 216 in the inner peripheral surface 219 or the outer peripheral surface 225 of the disc portion 212 can be cited.

Moreover, the groove portion 218 can be provided on both of the inner peripheral surface 219 and the outer peripheral surface 225 of the disc portion 212. In the analysis by the inventor and the like, the stress generated in the fitting hole portion 215 and the through hole portion 216 was smaller in the case where the groove portion 218 was provided on the inner peripheral surface 219 than the case of being provided on the outer peripheral surface 225. Moreover, when the groove portion 218 was provided on the both inner peripheral surface 219 and the outer peripheral surface 225 of the disc portion 212 as described above, the stress was averaged, and the effect of the stress distribution was further improved.

Moreover, according to analysis by the inventor and the like, when the thickness H of the disc portion 212 (FIG. 5) is made smaller, the effect of the stress distribution by provision of the groove portion 218 is prominent. Furthermore, in the examples in FIG. 1 and FIG. 5, the groove portion 223*a* facing the plate surface of the counterbore 220 is formed on the outer peripheral part of the bottom part in the recessed portion 223, and this groove portion 223*a* can be also considered to have the stress distribution function.

Figure 13:
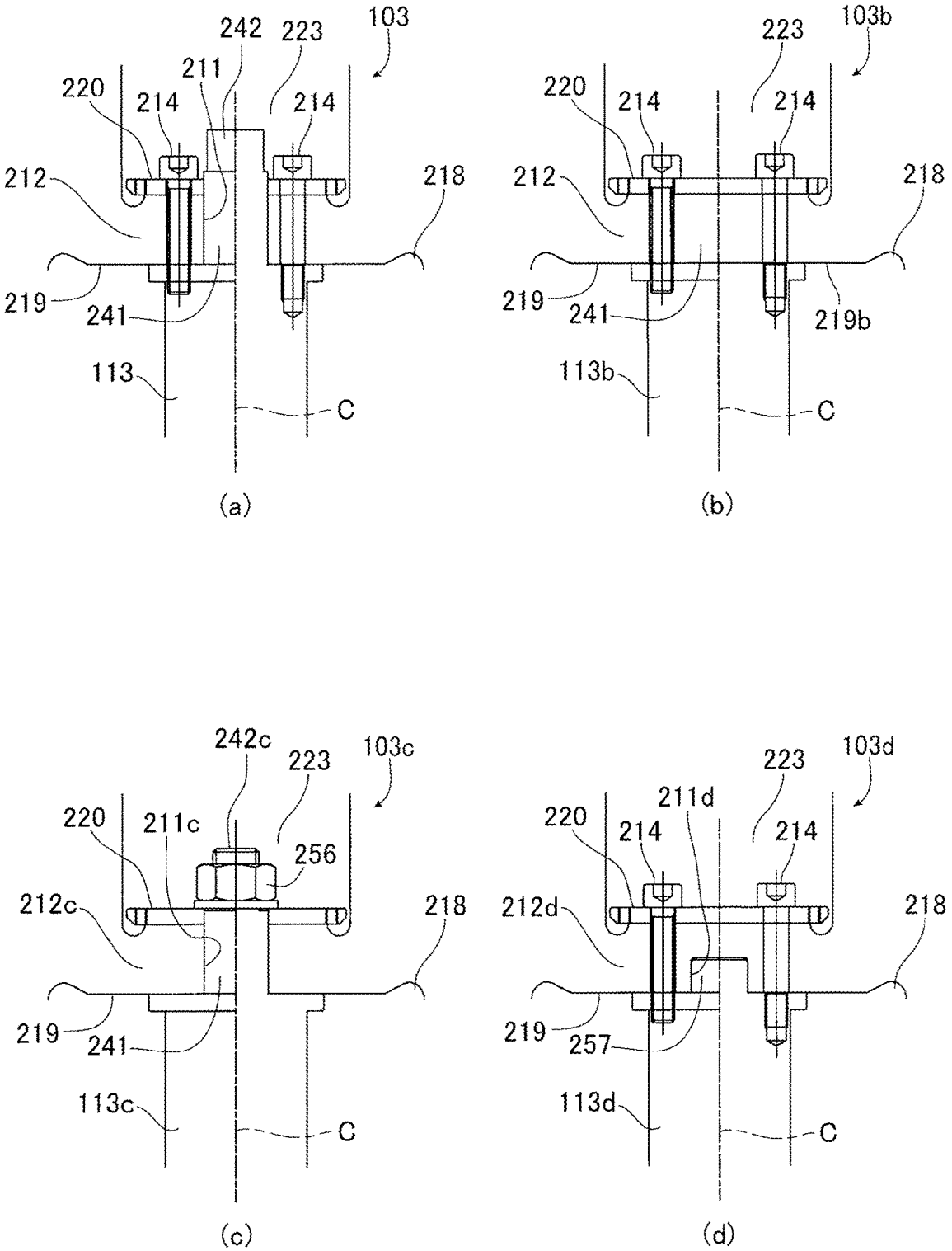
FIG. 13(*a*) is an explanatory diagram illustrating a connection relationship between the rotating body and a rotor shaft shown in FIG. 1 and FIG. 5, FIG. 13(*b*) is an explanatory diagram illustrating a variation of the rotating body, FIG. 13(*c*) is an explanatory diagram illustrating another variation of the rotating body, and FIG. 13(*d*) is an explanatory diagram illustrating still another variation of the rotating body.

Moreover, in FIG. 1, FIG. 5 and the like, with regard to the connection relationship between the rotating body 103 and the rotor shaft 113, such a type that the rotor shaft 113 is inserted so as to penetrate the fitting hole 211 of the rotating body 103 is exemplified, but the present invention is not limited to that, and as shown in FIGS. 13(*b*) to 13(*d*), for example, it can be also applied to various types of rotating bodies 103*b* to 103*d* as shown in partially vertical sections.

For example, FIG. 13(*a*) illustrates a part of the rotating body 103 according to the embodiment shown in FIG. 5 (disc portion 212) in an enlarged manner as a partially and vertical section, but this is not limiting, and as shown in FIG. 13(*b*), the present invention can be applied also to the type of the rotating body 103*b* which does not include the fitting hole (reference numeral 211 in FIG. 5) and to which the rotor shaft 113*b* is connected. The rotor shaft 113*b* shown in FIG. 13(*b*) is the one not including the fitting shaft portion 241 or the protruding end portion 242 in the example shown in FIG. 13(*a*). As described above, for the structure in which the rotor shaft 113*b* abuts against the rotating body 103*b* so as to fasten the both, the groove portion 218 is disposed on the fastened surface of the rotating body 103*b* (an inner peripheral surface 219*b* against which the rotor shaft 113*b* abuts) or an extended surface thereof.

Moreover, the one shown in FIG. 13(*c*) is a type of the rotating body 103*c* not having the bolt hole around the fitting hole 211*c* in the disc portion 212*c*. This type of the rotating body 103*c* is connected to the rotor shaft 113*c* such that a nut 256 is attached to a protruding end portion 242*c* in the rotor shaft 113*c*, and the counterbore 220 is pressed onto the rotating body 103*c* by fastening the nut 256.

Furthermore, the one shown in FIG. 13(*d*) is the type of the rotating body 103*d* in which the fitting hole 211*d* does not penetrate the disc portion 212*d* and is closed at a part in the middle of the thickness direction of the disc portion 212*d*. When this type of rotating body 103*d* is employed, the rotor shaft 113*d* is fixed to the rotating body 103*d* by the bolt 214 in a state where the rotor shaft 113*d* does not penetrate the disc portion 212*d*. Note that the rotating body 103*d* and the rotor shaft 113*d* shown in FIG. 13(*d*) can be considered as the one in which a protruding portion 257 formed on an end part in the axial direction of the rotor shaft 113*d* is inserted into a recess portion (reference numeral omitted) of the rotating body 103*d* so as to engage the rotor shaft 113*d* with the rotating body 103*d*.

Figure 14:
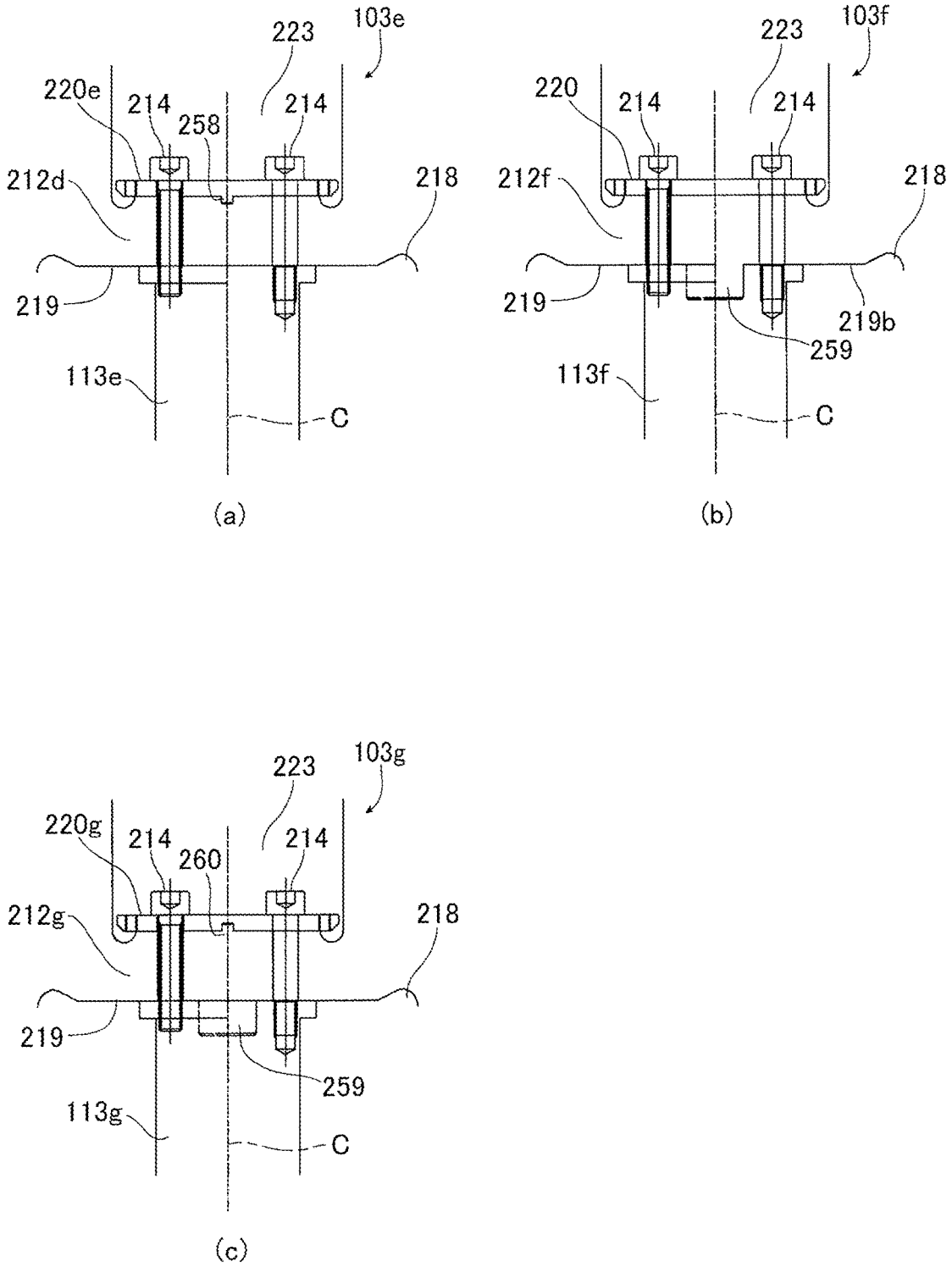
FIG. 14(*a*) is an explanatory diagram illustrating still another variation of the rotating body, FIG. 14(*b*) is an explanatory diagram illustrating still another variation of the rotating body, and FIG. 14(*c*) is an explanatory diagram illustrating still another variation of the rotating body.

Moreover, the one shown in FIG. 14(*a*) is a rotating body 103*e*, which is similar to the rotating body 103*b* of the type shown in FIG. 13(*b*) but is different in a point that it has an engagement structure by a protrusion 258 between it and a counterbore 220*e*. In the example in FIG. 14(*a*), the protrusion 258 is formed on the counterbore 220*e*, and this protrusion 258 enters a recess part (reference numeral omitted) of the rotating body 103*e*. As described above, the structure which causes the rotor shaft 113*b* to abut against the rotating body 103*b* so as to fasten the both, too, similarly to the example in FIG. 13(*b*), the groove portion 218 is disposed on the fastened surface of the rotating body 103*e* (an inner peripheral surface 219*e* against which the rotor shaft 113*e* abuts) or on the extended surface thereof.

Furthermore, the one shown in FIG. 14(*b*) is a type of a rotating body 103*f* having a protruding portion 259 and engaged with a rotor shaft 113*f* by inserting this protruding portion 259 into a recess part (reference numeral omitted) of the rotor shaft 113*f*.

Furthermore, the one shown in FIG. 14(*c*) is a type of a rotating body 103*g* having a protrusion 260 and the protruding portion 259, the protrusion 260 is caused to enter a recess part of the counterbore 220*g*, and the protruding portion 259 is inserted into a recess part (reference numeral omitted) of the rotor shaft 113*g* similarly to the example in FIG. 14(*b*).

In the turbo molecular pump including these various types of the rotating bodies 103*b* to 103*g* and the rotor shafts 113*b* to 113*g* and the like as described above, too, by providing the groove portions 218 and 223*a* at appropriate positions, the stress distribution function can be exerted similarly to the turbo molecular pump 100 shown in FIG. 1, FIG. 5 and the like.

Note that the present invention is not limited to the aforementioned embodiment but is capable of many variations by ordinary creative capabilities of a person ordinarily skilled in the art as long as they are within the technical scope of the present invention.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A vacuum pump having a rotating blade on an outer periphery of a cylinder part and including a rotating body fastened to a rotating shaft by a fastener and rotatable together with the rotating shaft, wherein in the rotating body, at least one of a fitting hole portion fitted with the rotating shaft and a through hole portion, through which the fastener penetrates, is a stress-reduction target portion, and a groove portion that reduces stress generated in the stress-reduction target portion during rotation of the rotating body is provided in the rotating body, the rotating body has a recessed portion, and the groove portion consists of a first groove portion provided adjacent a planar inner peripheral surface of the rotating body and a second groove portion formed on a bottom part in the recessed portion, wherein the planar inner peripheral surface extends within a geometric plane that includes a portion that extends across the first groove portion and wherein the first groove portion comprises an inclined surface extending from the planar inner peripheral surface at an acute angle relative to the portion of the geometric plane that extends across the first groove portion, wherein the first groove portion comprises an inner peripheral side and an outer peripheral side, wherein the inner peripheral side comprises the inclined surface and the acute angle of the inclined surface is smaller than an angle at which a surface of the outer peripheral side intersects with the portion of the geometric plane that extends across the first groove portion.

2. The vacuum pump according to claim 1, wherein the groove portion is provided closer to an outer peripheral side than the fitting hole portion or the through hole portion.

3. The vacuum pump according to claim 1, wherein the first groove portion is disposed on a fastened surface of the rotating body or on an extended surface thereof.

4. The vacuum pump according to claim 1, wherein the rotating body is applied with surface treatment, and has a counterbore portion, which avoids contact with the rotating shaft, on a peripheral edge part of at least one of the fitting hole portion and the through hole portion.

5. The vacuum pump of claim 1 wherein the inclined surface extends from the planar inner peripheral surface to the outer peripheral side of the first groove portion.

6. The vacuum pump of claim 5 wherein the rotating shaft rotates about an axis of rotation and wherein the inner peripheral side of the first groove portion has a width along the geometric plane in a radial direction relative to the axis of rotation and the outer peripheral side of the first groove portion has width along the geometric plane in the radial direction, the width of the inner peripheral side being greater than the width of the outer peripheral side.

7. The vacuum pump of claim 6 wherein the outer peripheral side comprises a curved surface extending from the inclined surface of the inner peripheral side to the geometric plane.

8. The vacuum pump of claim 6 wherein the outer peripheral side comprises an inclined surface and a curved surface, the inclined surface of the outer peripheral side extending from the geometric plane to the curved surface and the curved surface extending from the inclined surface of the outer peripheral side to the inclined surface of the inner peripheral side.

9. A rotating body for a vacuum pump having a rotor blade on an outer periphery of a cylinder part and fastened to a rotating shaft by a fastener, wherein at least one of a fitting hole portion fitted with the rotating shaft and a fastened part, to which the fastener is fastened, is a stress-reduction target portion, the rotating body including a groove portion which reduces stress generated in the stress-reduction target portion during rotation, the rotating body has a recessed portion, and the groove portion consists of a first groove portion provided adjacent a planar inner peripheral surface of the rotating body and a second groove portion formed on a bottom part in the recessed portion, wherein the planar inner peripheral surface extends within a geometric plane that includes a portion that extends across the first groove portion and wherein the first groove portion comprises an inclined surface extending from the planar inner peripheral surface at an acute angle relative to the portion of the geometric plane that extends across the first groove portion, wherein the first groove portion comprises an inner peripheral side and an outer peripheral side, wherein the inner peripheral side comprises the inclined surface and the acute angle of the inclined surface is smaller than an angle at which a surface of the outer peripheral side intersects with the portion of the geometric plane that extends across the first groove portion.

* * * * *